US006846759B1

(12) United States Patent
Copperwheat

(10) Patent No.: US 6,846,759 B1
(45) Date of Patent: Jan. 25, 2005

(54) ADHESIVE COATED POLYESTER FELT

(75) Inventor: Stephen D. Copperwheat, Rome, NY (US)

(73) Assignee: Knowlton Nonwovens, Inc., Utica, NY (US)

( * ) Notice: Subject to any disclaimer, the term of this patent is extended or adjusted under 35 U.S.C. 154(b) by 324 days.

(21) Appl. No.: 09/961,676

(22) Filed: Sep. 24, 2001

Related U.S. Application Data

(63) Continuation-in-part of application No. 09/198,546, filed on Nov. 24, 1998, now abandoned.

(51) Int. Cl.[7] ..... D04H 1/08

(52) U.S. Cl. ..... 442/320; 442/149; 442/268; 442/270; 442/286; 442/323; 442/381; 442/394; 442/402; 428/42.3; 428/343; 428/355 EP; 428/354; 428/904

(58) Field of Search ..... 442/149; 428/42.3, 428/343, 354, 355 EP, 904; 427/208

(56) References Cited

U.S. PATENT DOCUMENTS

| | | | | | |
|---|---|---|---|---|---|
| 5,532,050 | A | * | 7/1996 | Brooks | 428/220 |
| 5,874,136 | A | * | 2/1999 | Michna et al. | 428/31 |
| 6,008,149 | A | * | 12/1999 | Copperwheat | 442/381 |
| 6,180,211 | B1 | * | 1/2001 | Held | 428/172 |

FOREIGN PATENT DOCUMENTS

| | | |
|---|---|---|
| WO | WO 99/46116 | 9/1999 |

* cited by examiner

*Primary Examiner*—Arti R. Singh
(74) *Attorney, Agent, or Firm*—Wall Marjama & Bilinski LLP

(57) ABSTRACT

A method of making a soft, well cushioned, fabric suitable for use in an automotive interior, furniture and upholstery. The fabric which is formed by depositing a coating of a high temperature adhesive having a viscosity of $6\times10^4$ to $75\times10^4$ centipoise at its application temperature on one surface of a felt cloth followed by laying down a layer of a second material on top of the adhesive-coated surface of the felt cloth to form a composite. The composite is then passed through a hot pinch point to firmly bond the second layer to the felt cloth.

21 Claims, No Drawings

ADHESIVE COATED POLYESTER FELT

CROSS REFERENCE TO RELATED APPLICATIONS

This application is a continuation-in-part of application Ser. No. 09/198,546, filed on Nov. 24, 1998, now abandoned.

BACKGROUND OF THE INVENTION

Applicants pending application Ser. No. 09/198,546 filed Nov. 24, 1998 describes a composite laminate in general but relates more specifically to a laminate suitable for use with other laminates such as vinyl, nylons, polypropylenes, polyacrylics and rayons. Vinyl coatings are used for a wide variety of products including furniture, seating covers, upholstery and automotive interiors. Substrates for vinyl coating today are produced from various layers of materials which each have a function. A conventional state of the art construction for the supporting substrate is:

100% polyester needlepunch felt low density open-celled polyurethane foam.

The above structure is then coated with an adhesive. A layer of vinyl polymeric film is then calendered and adhered to the substrate to produce the final laminate product.

The function of each layer is as follows:

Polyester felt—provides the laminate handle, softness, suppleness, and compressibility properties appropriate for use in the manufacture of furniture, luggage, or automotive interiors.

Polyurethane foam—is added to the felt to act as a barrier to keep the adhesive out of the felt to maintain the product soft and supple for the particular application. If the adhesive penetrates the felt, it tends to stiffen the final product and it becomes boardy. The foam has no other function, and does not enhance any of the other properties of the felt sheet. It is an added cost whose function could also be met by the addition of a film laminated to the felt, which is also expensive. The foam also adversely impacts recyclability of the substrate in that the polyurethane is not compatible with polyester when recycling plastics. It is also known that the polyurethane foam, when burned, will decompose to cyanide gas which is a safety issue with this material construction.

In adhering the vinyl coating to the substrate, an adhesive coating, typically a water-based latex, is used. The dimensional stability of this product is an ongoing problem with the laminate manufacturing process.

It can be seen from the above that there is a need for lower cost felt substrates, and furthermore, a substrate which can overcome the problems described above which are associated with current substrates.

SUMMARY OF THE INVENTION

It is therefore an object of the present invention to provide a relatively low cost adhesive coated felt.

It is another object of the present invention to provide a high viscosity adhesive coating for a felt which obviates the need for a barrier layer and reduces production cost.

It is a further object of the present invention to provide an economical adhesive coated felt having comparable or improved physical properties.

It is yet another object of the present invention to provide an improved adhesive for a felt which eliminates the need for a separate foam barrier layer.

It is still another object of this invention to provide a felt substitute for foam which regains its thickness after compression.

It is still another object of this invention to provide a felt substitute for foam which is tear and puncture resistant.

It is yet another objective of the present invention to provide an adhesive-coated felt substitute for bonding to decorative materials such as substrates such a dyed or printed polyesters, polypropylenes or nylons.

It is one more objective of the present invention to provide a felt substrate for bonding to a variety of woven or non-woven, stitch-bonded, brushed or brushed-web type materials.

It is a still further object of the present invention to provide a substrate which can be coated with a thick layer of vinyl which can be embossed to provide a cushioned, decorative composite material.

These and other objects are accomplished in accordance with the present invention whereby an adhesive is applied to, and resides on, the surface of a felt support to provide superior adhesion to vinyl and other materials such as woven, non-woven, brushed and knitted materials, and overcomes the need to have a barrier layer for preventing adhesive penetration into the felt layer.

More specifically the present invention allows for the elimination of the polyurethane foam by applying a high viscosity adhesive coating to the surface of the felt. Although the present invention illustrates the use of a polyester felt, it should be understood that any suitable felt may be used. For example, nylon, polypropylene, rayon and polyacrylic felts may also be used. The resulting structure has the following advantages over the existing state of the art:

1. Lower cost product.

2. The high viscosity coating of adhesive does not penetrate into the body of the felt. It is believed that the adhesive resides mainly on the substrate surface, and at most, penetrates only a few fiber thickness into the body of the substrate. This provides for substantially all of the adhesive being available for bonding. This objective can be achieved by combinations of application techniques and adhesive viscosities. One suitable method of accomplishing the above objective would be the use of a Stork Foam Adhesive Applicator for applying the appropriate adhesive substrate. Since the adhesive forms an essentially non-penetrating layer on the surface of the substrate, it acts as a barrier layer also. This obviates the need for a separate barrier layer for the felt. Consequently, one can safely eliminate polyurethane foam, the current barrier layer of choice. The resulting product is also very soft, supple and resilient and quickly regains its thickness after being subjected to pressure. In addition, it has increased tear and puncture resistance.

3. Additionally, since most of the adhesive stays directly on top of the felt surface and is available for adhesion, much less adhesive is required to adhere the vinyl or any other polymeric or non-polymeric film to the felt layer. The process of the invention uses between about 0.05 and 1.35 oz/yd$^2$ of adhesive addition versus the industry standard of 1.0 to 5.0 oz/yd$^2$. Any process capable of dispensing a high viscosity adhesive to the top of a fabric is acceptable for producing this product. This would include coating processes that apply pastes, powdered foamed adhesive processes, hot melt adhesive processes, any spray processes that can spray thixotropic materials as well as thin film transfer processes usually applicable to B-stage adhesives.

DETAILED DESCRIPTION OF THE INVENTION

A conventional polyester felt with a 0.030 inches thick polyurethane foam layer on one surface of the polyester is made as follows:

Fiber bales are opened and fiber is loaded into fiber hoppers and preblended into a specific weight blend. Fiber bundles are further mixed and transported by air to a holding bin to feed the card process. Blended and opened fibers are fed to the card which combs fibers into a fibrous web. Webs are layered one on top of another by a crosslapper to build a heavy weight feed mat to feed the needle looms. The resultant feed mat has a density of about 6.0 oz/yd$^2$.

Crosslapped web is then fed to a needle loom. Barbed needles pass through the web and further entangle fibers together to provide strength to the web. The web is simultaneously stretched in the machine direction and the web density drops to about 4.5 oz/yd$^2$. The polyurethane foam is unrolled and laid onto the top of the needled web as it exits the first loom. The foam is 0.030" thick polyurethane foam type LDM, 0.5 oz/yd$^2$ (LDM=low density, mildew resistant) available from W M. T. Bumett Co. or General Foam Corp. The needled web/foam combination is then passed through a second needle loom as it is being stretched in the machine direction and the fibers from the polyester web are carried into the foam by the needling action. This forms a sheet of composite material with a fmal density of about 4.0 oz/yd$^2$. The sheet is then slit into three 62"-wide rolls. Subsequent process steps are packaging and testing. Following testing and packaging, the rolls are then ready for lamination with vinyl. It should be understood that the width of the sheet can vary depending upon use requirements.

In one embodiment of the present invention, the web used is a blend of 75% 3 denier×3" and 25% 1.5 denier×1.5" polyester fiber available from Kosa. The web is obtained by treating the above blend, i.e., 75% 3 denier×3" and 25% 1.5 denier×1.5" polyester fiber from Kosa, as follows:

Fiber bundles are opened and transported by air to a feeding bin to feed the carding process as before. Blended and opened fiber bundles are fed into the card and combed into a continuous, fibrous web. The web is, then, transported to a crosslapper and lapped to the desired density. The preferred web density at this stage is approximately 6 oz/yd$^2$. Subsequently, this web is fed through a second needlepunch loom while being stretched in the machine direction at the same time. The simultaneous stretching and punching of the web in the second needlepunch loom helps to decrease the fiber density while at the same time interlocking fibers in different layers of the felt providing additional strength to the felt. The felt density following this step is 4 oz/yd$^2$. The sheet is slit into three 62"-wide rolls. The polyester web is then tested for quality control. Afterwards, the web is packaged and sent to a coater for adhesive addition.

In another embodiment of the invention, a blend consisting of 50% 6 denier×3" type 180 PCT Polyester and 50% 3 denier×1.5" type 180 PCT is used. Both materials are manufactured by Fiber Innovations Technologies. Fiber bundles are once again opened and transported by air to a feeding bin to feed the carding process as before. Blended and opened fiber bundles are fed into the card and combed into a continuous web. The web is, then, transported to a crosslapper and lapped to the desired density. A preferred density at this stage is 6 oz/yd$^2$. Subsequently, the crosslapped web is sequentially fed through two needle looms to mechanically entangle the individual fibers in the web. The first loom needles the web from the top whereas the second needle loom needles the web from the bottom. During its passage through the second needle loom the web is also stretched in the machine direction while it is being punched at the same time. The stretching, machine speed and punching are adjusted to give the web a desired thickness and density. The weight of the resultant web after passing through the second needle punch loom is 4 oz/yd$^2$. The material is then slit to the prescribed width and wound on a core to the specified length.

Subsequent processing steps are the similar for the two webs, one from each of the two embodiments.

A roll of 4.0 oz/yd$^2$ polyester felt from either of the two embodiments described above is unwound and fed into a coating machine. A high viscosity polyester based adhesive, (GRILTEX® 9 and the other four adhesives listed in Table I are all available from EMS-American Grilon, Inc.) is applied to the face of the sheet and dried. The average weight of applied adhesive can vary between 0.05 to 1.35 oz/yd$^2$ depending upon the fiber blend used and the nature of the adhesive applied. For the fiber blend of the first embodiment, the adhesive weight is preferably in the range of 0.05 to 0.75 oz/yd$^2$. Concentrations below about 0.05 oz/yd$^2$ do not provide sufficient bond strength to produce an acceptable laminate, while concentrations above about 0.75 oz/yd$^2$ result in unacceptable softness and handle properties in the laminate. Similarly, the preferred adhesive weight for the fiber blend of the second embodiment is usually between 0.5 to 1.35 oz/yd$^2$. Here again adhesive weights above 1.35 oz/yd$^2$ results in unacceptably boardy laminate.

TABLE I

| Adhesive | Applicable Temp. Range (Deg. C.) | Viscosity in the Applicable Temp. Range (Centipoise) | Application Temperature (° C.) | Viscosity @ The Temp. of Application (Centipoise) |
|---|---|---|---|---|
| GRILTEX ® D 1439E | 130–200 | (2,200, – 460) × $10^3$ | 180 | 750 × $10^3$ |
| GRILTEX ® 9 | 130–240 | (560 – 27) × $10^3$ | 180 | 130 × $10^3$ |
| GRILTEX ® 6 | 130–240 | (1,600 – 60) × $10^3$ | 180 | 300 × $10^3$ |
| GRILTEX ® D 1309E | 160–250 | 400 – 20) × $10^3$ | 180 | 150 × $10^3$ |
| GRILTEX ® D 1310E | 180–240 | (62 – 13) × $10^3$ | 180 | 60 × $10^3$ |

The dispensing temperature of an adhesive can vary depending upon the nature of the adhesive but is typically between 130–240° C. (See Table I) In this range, the viscosity of an adhesive useful for this application can vary from 2,200–13×$10^3$ centipoise. The list of useful adhesives includes Griltex D 1439E, Griltex 6, Griltex D 1309E and Griltex D 1310E in addition to Griltex 9. These are all high viscosity adhesives. Although these adhesives can be applied to the polyester web between 130–240° C., a preferable temperature range is between 150–210° C. An even more preferred temperature range for their application is 170–190° C. and an even more preferred temperature range for their application is 175–185° C. Adhesive viscosity usually varies from 13×$10^3$ to 2,200×$10^3$ in the useful temperature range of 130–240° C. However, a more preferred viscosity range would be 60×$10^3$ to 2,000×$10^3$ centipoise. A still more preferred viscosity range would be 100×$10^3$ to 800×$10^3$ centipoise. Other acceptable adhesives include high viscosity liquid/adhesives, hot melt adhesives, frothed or foamed or sprayed adhesives, web adhesives and powdered adhesives. One can also use B-stage thermoset adhesives for these applications. These include any B-stage epoxy adhesives except that one would then require an additional curing step for those adhesives. Any process that can apply any of these or other similar materials to the surface of a felt without them penetrating significantly into the depth of the felt base fabric are acceptable. The adhesive-coated sheet is then dried in an oven and wound for lamination with other substrates. The following comparative test data illustrates the advantages of the first embodiment of the present invention over the prior art described above.

Comparison of Prior Art Versus Invention

| | Invention(First Embodiment) | |
|---|---|---|
| Process Comparison | Prior Art | Example 1 |
| Adhesive weight applied (oz/yd$^2$) | 0.9 | 0.28 |
| Laminator line speed (ypm) | 18 | 18 |
| Temperatures (° F.) | | |
| Drum roll | 290–315 | 250 |
| Radiant heat | 300–320 | 300–320 |
| Embossing Pressure (psi) | 700 | 700 |
| Vinyl exposure time (sec) | | |
| Drum roll | 3 | 3 |
| Radiant heat | 6 | 6 |
| Total | 30 | 30 |
| Adhesive type | proprietary | EMS Griltex 9P |
| Adhesive Viscosity (centipoise) | 3000–8000 @25° C. | 130 × 10$^3$ @180° C. |
| Nonwoven base needlepunch fabric | 100% PET | 100% PET |
| Base fabric basis weight (oz/yd$^2$) | 4.0 | 4.0 |

Test results (according to Chrysler Specification MS-JKS3-56)

| Test | Spec. Value | 0.28 oz/yd$^2$ |
|---|---|---|
| Weight oz/yd$^2$ | 21+/−2 | 20.2<br>21.0<br>20.5 |
| Set (%) | | |
| warp | max 20% stretch | 2.08, 3.13, 3.13 |
| fill | max 20% stretch | 3.13, 3.13, 3.13 |
| Bond (lbf/inch) | 5.5 | 14.72, 16.48, 15.47 |
| Grain Retention | TBD | excellent |

It can be seen from the above test data that the process and resulting product of the present invention can use as low as ¼ of the adhesive required by conventional prior art processing. It also provides for superior bond strength with the vinyl polymeric film while providing a product which is soft and supple.

A preferred range of adhesive depends upon the nature of the substrate/laminate combination. For example, for a 75% 3 denier×3" and 25% 1.5 denier×1.5" polyester and Griltex 9 adhesive laminated to vinyl, the preferred adhesive add on is in the range of about 0.1 to 0.3 oz/yd$^2$. For other combinations, it could be as high as 1.0 to 1.35 oz/yd$^2$.

The adhesive coated felt substrates of the two embodiments discussed earlier as well as other similarly treated substrates are now ready for further processing. For example, two adhesive coated felt substrates, whether similar or dissimilar, could be bonded together to obtain a thicker and more cushiony substrate for use in bicycle, motorbike or car seats or as a cushion in sofas and mattresses etc. In another application, the adhesive-coated substrate could be bonded to other materials like printed or dyed polyesters, polypropylenes, nylons or other similar materials. These materials could be either woven, non-woven, stitch-bonded, brushed or brushed-web type. Bonding of the various materials to the felt substrates with a laminated layer of adhesives as described in the two embodiments of the invention can be carried out at approximately 320 F or 160° C. This is achieved by marrying the felt substrate with a laminated layer of adhesive to the other substrate and passing the sandwich through a hot pinch point of approximately 320 F or 160° C.

Alternately, one could also extrude a layer of vinyl onto a substrate. In the extruded vinyl process, the molten vinyl is extruded at 315–330 F or 155–165° C. directly onto the substrate the adhesive layer and pressed to the substrate with an embossing roll. In this case, the extruded layer would require the adhesive layer to act as a barrier layer that prevents the molten vinyl from penetrating into the fibers.

While the present invention has been particularly shown and described with reference to the preferred modes as illustrated in the various drawings, it will be understood by one skilled in the art that various changes in detail may be effected therein without departing from the spirit and scope of the invention as defined by the claims.

What is claimed is:

1. A soft, well cushioned, fabric suitable for use in an automotive interior, furniture and upholstery which is formed by the steps consisting essentially of:

depositing a coating of a high temperature adhesive having a viscosity of $6\times10^4$ to $75\times10^4$ centipoise at its application temperature on one surface of a felt cloth;

laying down a layer of a second material on top of said adhesive-coated surface of said felt cloth to form a composite; and passing said composite through a hot pinch point to firmly bond said second layer to said felt cloth.

2. A soft, well cushioned, fabric of claim 1, wherein said second material can be selected from a group consisting of woven, non-woven, brushed or knitted material.

3. A soft, well cushioned, fabric of claim 2, wherein said felt cloth is a polyester felt cloth.

4. A soft, well cushioned, fabric of claim 2, wherein said felt cloth is selected from a group consisting of nylon, polypropylene, rayon and polyacrylic.

5. A soft, well cushioned, fabric of claim 2, wherein said felt cloth is a needlepunched polyester felt cloth.

6. A soft, well cushioned, fabric of claim 5, wherein said needlepunched polyester felt cloth is a blend of 75% 6 denier×3" and 25% 1.5 denier×1.5" polyester fibre.

7. A soft, well cushioned, fabric of claim 6, wherein the coating weight of said high temperature adhesive is between 0.05–0.75 oz/yd$^2$.

8. A soft, well cushioned, fabric of claim 7, wherein the coating weight of said high temperature adhesive is between 0.75–1.35 oz/yd$^2$.

9. A soft, well cushioned, fabric of claim 1, wherein said second substrate is selected from a group consisting of printed or dyed polyester, polypropylene and nylon.

10. A soft, well cushioned, fabric of claim 9, wherein said felt cloth is a polyester felt cloth.

11. A soft, well cushioned, fabric of claim 10, wherein said felt cloth is a needlepunched polyester felt cloth.

12. A soft, well cushioned, fabric of claim 11, wherein said needlepunched polyester felt cloth is a blend of 75% 6 denier×3" and 25% 1.5 denier×1.5" polyester fibre.

13. A soft, well cushioned, fabric of claim 12, wherein the coating weight of said high temperature adhesive is between 0.05–0.75 oz/yd$^2$.

14. A soft, well cushioned, fabric of claim 9, wherein said felt cloth is selected from the group consisting of nylon, polypropylene, rayon and polyacrylic.

15. A soft, well cushioned, multi-layered fabric suitable for use in an automotive interior, furniture and upholstery which is formed by steps consisting essentially of:

depositing a coating of a high temperature adhesive having a viscosity of $6\times10^4$ to $75\times10^4$ centipoise at its application temperature on two opposite surfaces of a felt cloth;

laying down a decorative second substrate on one of said adhesive-coated surfaces and a third substrate on said opposite adhesive-coated surface of said felt cloth to form a composite; and passing said composite through a hot pinch point to firmly bond said decorative second substrate and said third substrate to opposite surfaces of said felt cloth.

16. A soft, well cushioned, multi-layered fabric of claim 15, wherein said third substrate is selected from a group consisting of a printed or dyed polyester, polypropylene and polyacrylic.

17. A soft, well cushioned, multi-layered fabric of claim 16, wherein said felt cloth is selected from the group consisting of nylon, polypropylene, rayon and polyacrylic.

18. A soft, well cushioned, multi-layered fabric of claim 15, wherein said felt cloth is a polyester felt cloth.

19. A soft, well cushioned, multi-layered fabric of claim 18, wherein said needlepunched polyester felt cloth is a blend of 75% 6 denier×3" and 25% 1.5 denier×1.5" polyester fibre.

20. A soft, well cushioned, multi-layered fabric of claim 15, wherein the coating weight of said high temperature adhesive is between 0.05–0.75 oz/yd$^2$.

21. A soft, well cushioned, multi-layered fabric of claim 15, wherein the coating weight of said high temperature adhesive is between 0.75–1.35 oz/yd$^2$.

* * * * *